United States Patent [19]

Mori et al.

[11] Patent Number: 4,634,927

[45] Date of Patent: Jan. 6, 1987

[54] SMALL METAL HALIDE LAMP

[75] Inventors: Yasuki Mori, Yokohama; Akihiro Kamiya, Yokosuka, both of Japan

[73] Assignee: Tokyo Shibaura Denki Kabushiki Kaisha, Kawasaki, Japan

[21] Appl. No.: 449,690

[22] Filed: Dec. 14, 1982

[30] Foreign Application Priority Data

Dec. 25, 1981 [JP] Japan ..... 56-215571

[51] Int. Cl.[4] ..... H01J 1/63; H01J 61/20; H01J 61/35

[52] U.S. Cl. ..... 313/486; 313/637; 313/642

[58] Field of Search ..... 313/486, 487, 637, 641, 313/642

[56] References Cited

U.S. PATENT DOCUMENTS

| | | | |
|---|---|---|---|
| 3,407,327 | 10/1968 | Koury et al. | 313/229 |
| 4,023,059 | 5/1977 | Anderson | 313/637 X |
| 4,161,672 | 7/1979 | Cap et al. | 313/220 |
| 4,171,498 | 10/1979 | Fromm et al. | 313/641 |
| 4,423,349 | 12/1983 | Nakajima | 313/486 X |

FOREIGN PATENT DOCUMENTS 135581 3/1977 Japan .

*Primary Examiner*—David K. Moore
*Assistant Examiner*—K. Wieder
*Attorney, Agent, or Firm*—Cushman, Darby & Cushman

[57] ABSTRACT

This invention provides a small metal halide lamp which has a power input of 100 W or less, provided with: an arc tube having a pair of electrodes spaced apart from each other and containing a rare gas, mercury, sodium halide and scandium halide therein; and an envelope for housing the arc tube. The mixing ratio of sodium halide to scandium halide based on weight is 3:1 to 10:1, and the total content of the sodium halide and the scandium halide is 10 to 40 mg per unit volume (cc) of the arc tube. At least one phospor selected from the group consisting of a manganese-activated magnesium fluorogermanate phosphor and a cerium-activated yttrium aluminate phosphor is applied to the inner surface of the envelope. In addition, a green-emitting phosphor is preferably coated on the inner surface of the envelope.

8 Claims, 9 Drawing Figures

SMALL METAL HALIDE LAMP

BACKGROUND OF THE INVENTION

The present invention relates to a small metal halide lamp having a rated power of not more than 100 W and, more particularly, to a small metal halide lamp which emits light having a similar color tone and similar spectral characteristics to those of an incandescent lamp.

From the viewpoint of energy consumption, there has been great demand recently for a small metal halide lamp having a high luminous efficacy and high color rendering properties, to replace incandescent lamps which have been widely used as indoor light sources in stores and in the home.

Medium and large size metal halide lamps of a power greater than 100 W are already known and used. Among these metal halide lamps, the large metal halide lamp has a luminous flux value significantly greater than that of the incandescent lamp, so that it is installed at a relatively higher position to effectively utilize this amount of light even if it is used indoors where high color rendering properties are required. Although metal halide lamps have both a high luminous flux value and high color rendering properties, they do not often receive much attention. In order to use a metal halide lamp in place of the incandescent lamp, an object must be directly irradiated in the same manner as with an incandescent lamp so as to emphasize the color tone of the object. For this purpose, the color rendering properties of the metal halide lamp are very important in providing warm color lighting indoors (based on elements such as the color tone of light and the color temperature), and in eliminating any disharmony between a metal halide lamp and an incandescent lamp which may be used together as light sources.

The color temperature of the metal halide lamp is preferably as low as 3,000 K, as compared with the color temperature of the incandescent lamp. Furthermore, the chromaticity of the metal halide lamp must not greatly deviate from the black body locus (to be referred to as a BBL hereinafter). The high luminous efficacy of the metal halide lamp must also be retained from the viewpoint of low power consumption.

In a metal halide lamp, the type of halide to be contained in an arc tube largely determines various characteristics such as the color temperature, luminous efficacy, and color rendering properties. Especially, among the conventional halides, sodium halide and scandium halide are suitable as halides which provide a low color temperature, a high luminous efficacy and high color rendering properties, in accordance with studies made in the development of the large metal halide lamp. However, when the techniques used for manufacturing the large metal halide lamps are used for manufacturing a small metal halide lamp having a rated power of 100 W or less, various problems are presented.

One of the problems is degradation in luminous efficacy of the lamp. When the lamp size is decreased, its luminous efficacy is generally degraded. The following causes for the degradation in luminous efficacy are considered: circulation of metal vapor cannot be smoothly performed since the discharge space is decreased; and since the sealed portion is increased with respect to the discharge space and the heat loss from the sealed portion is increased, the temperature of the coldest spot cannot be increased, thereby decreasing evaporation of the contained metal.

In order to eliminate the above problems, the arc tube is formed to have a spheroidal or ellipsoidal shape so as to accelerate the circulation of gas in the discharge space. Furthermore, the sectional area of the sealed portion is decreased to prevent heat loss, thereby increasing the temperature of the spot of the coldest temperature. Alternatively, a tube wall load is increased as compared with that of the medium and large metal halide lamps. In the small metal halide lamp which has sodium halide and scandium halide and which is treated to prevent degradation in luminous efficacy, its color temperature is decreased by about 500 to 600 K as compared with a color temperature of 4,000 K of a metal halide lamp of 400 W. Furthermore, the color rendering properties of the small metal halide lamp of the type described above are slightly improved. This is because the light-emitting intensity of the contained material must be increased to compensate for the heat loss when the size of the metal halide lamp is decreased. This improvement is preferable to achieve the color temperature and color rendering properties of the metal halide lamp which resemble those of the incandescent lamp. However, in the small metal halide lamp which provides a high luminous efficacy, high color rendering properties, and a low color temperature, the chromaticity is greatly deviated from the BBL. The color tone of light becomes pinkish or of red purple due to an increase in light emission from sodium, resulting in a great difference from the color of light from the incandescent lamp. In this manner, when the color of light from the metal halide lamp differs greatly from that of light from the incandescent lamp, disharmony between these colors is presented. As a result, warm color lighting and comfort, which are requirements for indoor lighting, are impaired.

The present inventors have made extensive studies on the small metal halide lamp of the type described above so as to improve the color tone of light therefrom. It is found that a phosphor coated on the inner surface of an envelope improves the color of light emitted therefrom to eliminate disharmony between the small metal halide lamp and the incandescent lamp. The essential object of the present invention is to improve the color tone of light emitted from the lamp by coating a phosphor on the inner surface of the envelope.

The technique of applying a phosphor on the inner surface of the envelope to substantially equalize the spectral characteristics of a metal halide lamp with those of an incandescent lamp is described in Japanese Patent Disclosure No. 52-135,581 (to be referred to as the prior art hereinafter). In the technique described in the prior art, the objective is the manufacture of medium and large metal halide lamps having a rated power of 400 W. Therefore, the prior art differs from the present invention in which a metal halide lamp of 100 W or less is an essential objective.

In a chromaticity diagram shown in FIG. 1, the spectral characteristics of the arc tube of the prior art are distributed on or above the BBL, as the color tone of light emitted from the arc tube is indicated by a circle. When a red and green phosphor is coated on the inner surface of the envelope, the spectral characteristics can be improved as indicated by arrows A and B. Specifically, when the red phosphor is used, the color temperature is changed as indicated by arrow A along the X-axis on the X-Y coordinates. The color temperature can be decreased to about 3,000 K. However, when the color temperature is decreased to about 3,000 K using the red phosphor, the spectral characteristics are greatly deviated from the BBL. In order to compensate for this deviation, the green phosphor is used to redistribute the circles along the Y-axis so as to obtain the spectral characteristics which resemble those of the incandescent lamp.

In the small metal halide lamp of 100 W or less according to the present invention, it is found that the color tone of light emitted from the arc tube which is treated to prevent degradation in luminous efficacy, color rendering properties and color temperature is distributed as indicated by a square. The position of the square is lower than that of the BBL, but the color temperature is considerably low. The color tone of light from the metal halide lamp of the type described above can be converted such that the squares are moved in the direction indicated by arrow C. The color temperature need not be decreased but the chromaticity should be increased along the Y axis to come close to the BBL.

When the prior art is applied to the small metal halide lamp according to the present invention, the color temperature is decreased too much to move squares in the direction parallel to the direction indicated by arrow A, so that the squares are greatly deviated from the BBL. Therefore, the squares must be moved upward along the Y-axis using the green phosphor. However, it is impossible to correct such a great deviation as described using the conventional green phosphor. A phosphor which absorbs blue light is thus required.

As described above, according to the prior art, the chromaticity of light emitted from the medium and large metal halide lamps, that is, from the arc tubes of the lamps, is distributed above the BBL. The technique of the prior art is effective when the light is distributed on or slightly below the BBL. However, the prior art cannot be applied to the small metal halide whose chromaticity has a deviation of 0.010 UV from the BBL.

SUMMARY OF THE INVENTION

It is an object of the present invention to provide a small metal halide lamp which has a high efficiency, high color rendering properties, and a low color temperature and which has improved chromaticity.

In order to achieve the above object of the present invention, there is provided a small metal halide lamp which has a power input of 100 W or less, comprising: an arc tube having a pair of electrodes spaced apart from each other and containing a rare gas, mercury, sodium halide and scandium halide therein; and an envelope housing said arc tube; wherein a mixing ratio based on weight of the sodium halide to the scandium halide is 3:1 to 10:1, and a total content of the sodium halide and the scandium halide is 10 to 40 mg per unit volume (cc) of said arc tube, and wherein at least one phosphor selected from the group consisting of a manganese-activated magnesium fluorogermanate ($Mg_8Ge_2O_{11}F_2$:Mn) phosphor and a cerium-activated yttrium aluminate ($(Y_{1-x}Ce_x)_3Al_5O_{12}$) phosphor is applied to an inner surface of said envelope.

A green-emitting phosphor may be further applied to the inner surface of the envelope. The green-emitting phosphor preferably consists of a terbium-activated green-emitting phosphor, examples of which may include: cerium-, terbium-activated yttrium silicate ($Y_2Si_5O_5$:Ce,Tb); cerium-, terbium-activated magnesium aluminate ($(Ce,Tb)MgAl_{11}O_{19}$); terbium-activated yttrium phosphate ($YPO_4$:Tb); terbium-activated lanthanum phosphate ($LaPO_4$:Tb); cerium-, terbium-activated lanthanum phosphate ($LaPO_4$:Ce,Tb); and a material obtained by substituting part of the lanthanum of cerium-, terbium-activated lanthanum phosphate by another element.

BRIEF DESCRIPTION OF THE DRAWINGS

FIG. 3 is a chromaticity diagram,

FIG. 4 is a graph for explaining the color temperature as a function of the amount of a phosphor applied to the inner surface of an envelope, FIG. 5 is a graph for explaining the average color rendering index as a function of the amount of the applied phosphor, FIG. 6 is a graph for explaining the deviation of chromaticity from the BBL as a function of the amount of the applied phosphor, FIG. 7 is a chromaticity diagram thereof, FIG. 8 is a graph showing the spectral distribution, and FIG. 9 is a graph showing the lumen maintenance factor.

DETAILED DESCRIPTION OF THE PREFERRED EMBODIMENT

A small metal halide lamp according to an embodiment of the present invention will be described with reference to FIGS. 2 to 9.

Figure 2:
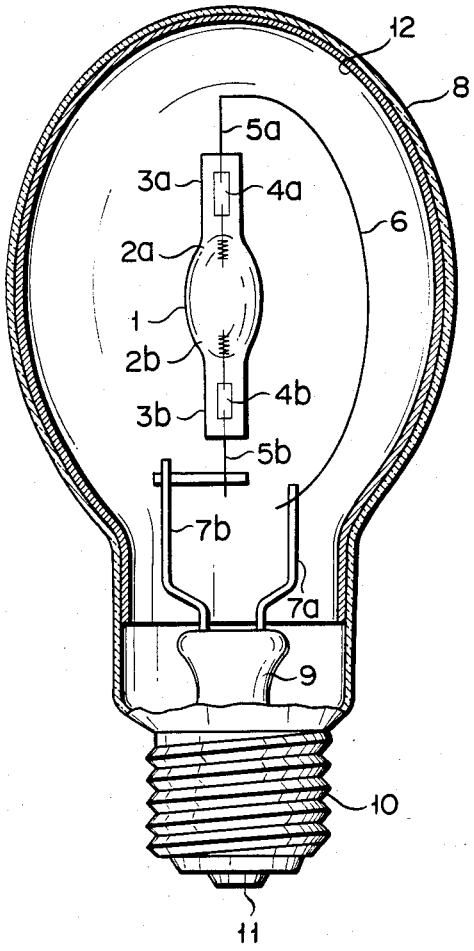
FIG. 2 is a sectional view of a small metal halide lamp according to an embodiment of the present invention.

Referring to FIG. 2, an arc tube 1 is made of a heat-resistant translucent material. Electrodes 2*a* and 2*b* of tungsten or the like are disposed at two ends of the arc tube 1. The electrodes 2*a* and 2*b* are connected to molybdenum films 4*a* and 4*b* which are sealed in sealed portions 3*a* and 3*b*, respectively. The molybdenum films 4*a* and 4*b* are respectively connected to inlead portions 5*a* and 5*b*. The inlead portion 5*a* is connected to an inner lead 7*a* through a lead wire 6. Similarly, the inlead portion 5*b* is connected to an inner lead 7*b*. The inner leads 7*a* and 7*b* are sealed and fixed on a stem 9 of an envelope 8 which is then connected to a terminal 11 of a base 10 at one end of the envelope 8.

The arc tube 1 is formed to have a spheroidal or ellipsoidal shape, thereby accelerating circulation of vaporized metal in the discharge space. A rare gas, mercury, sodium halide and scandium halide are sealed in the arc tube 1. The sectional areas of the sealed portions 3*a* and 3*b* are minimized, preventing heat loss from the sealed portions 3*a* and 3*b*. The temperature of a coldest spot is increased, thus accelerating the evaporation of metals. Since the sealed portions 3*a* and 3*b* smoothly terminate in the spheroidal or ellisoidal portion of the arc tube 1, the mechanical strength of the sealed portions is improved. Therefore, since the amount of evaporation of sodium halide and scandium halide is considerably great and the metal vapor is actively circulated in the discharge space, the luminous efficacy is improved.

Nitrogen gas or an inert gas is sealed in the envelope 8. A phosphor 12 is coated on the inner surface of the envelope 8. The phosphor 12 consists of at least one phosphor (to be referred to as a first phosphor 12 hereinafter) selected from the group consisting of a manganese-activated magnesium fluorogermanate phosphor and a cerium-activated yttrium aluminate phosphor. The average particle size of the first phosphor 12 is about 1 to 15μ.

A second phosphor consisting of a terbium-activated green-emitting phosphor may be mixed as a second phosphor in the first phosphor as needed. In this case, the average particle size of the second phosphor is 1 to 15μ. The second phosphor may be 40% or less of the total amount of the phosphors. When either only the first phosphor or the mixture of the first and second phosphors is used, the amount of the phosphor or phosphors is 0.5 to 2.0 mg/cm$^2$.

When a metal halide lamp of 40 W is exemplified, the arc tube 1 has an ellipsoidal structure having a major axis of 8 mm and a minor axis of 6 mm. The major axis is aligned with the longitudinal direction of the electrodes. Argon as the rare gas, mercury, sodium iodide and scandium iodide are contained in the arc tube 1. The arc tube 1 is housed in the envelope 8, and the phosphor 12 is coated on the inner surface of the envelope 8. The mixing ratio of sodium iodide to scandium iodide is changed variously to examine luminous efficacy.

Figure 3:
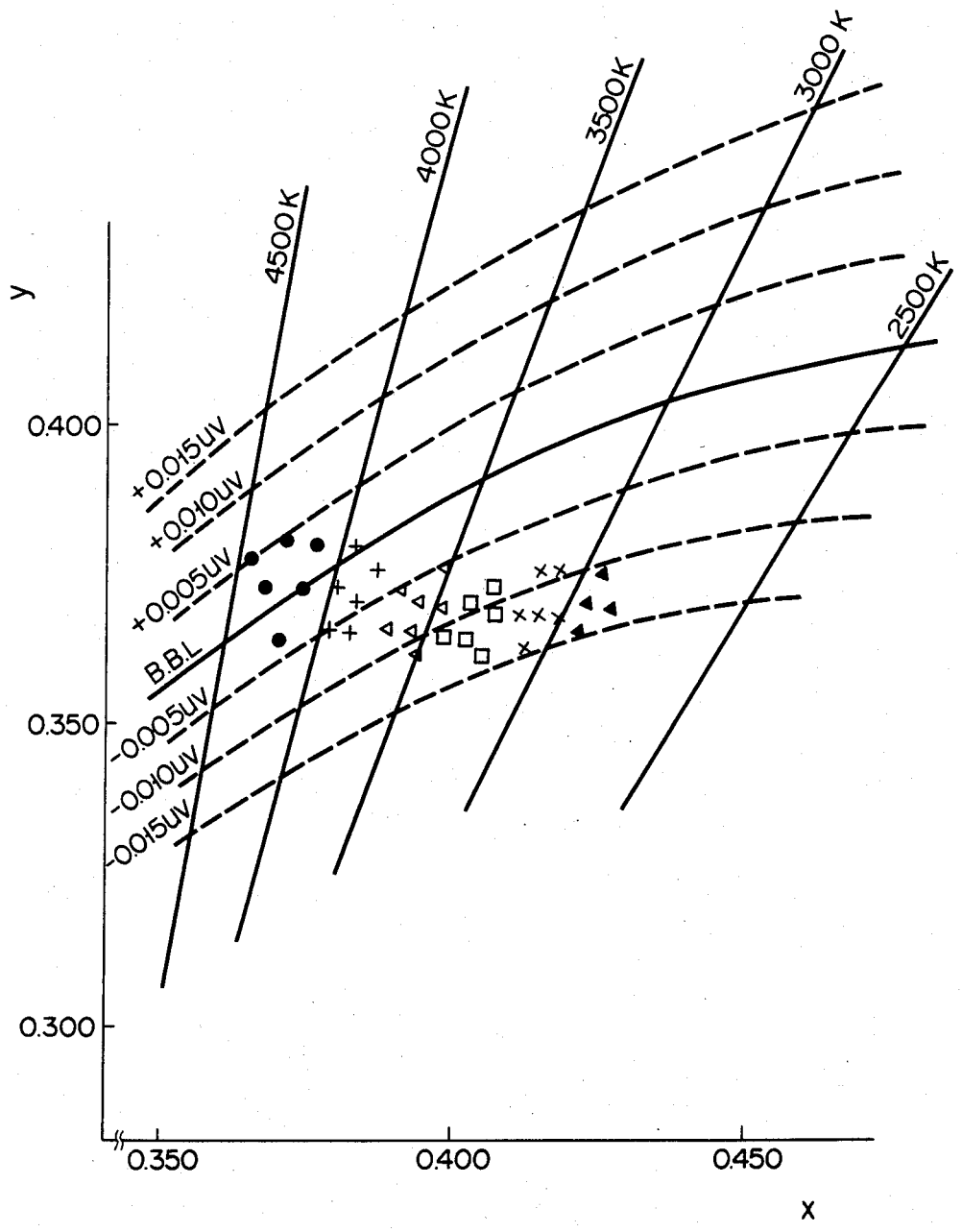
FIGS. 3 to 9 are graphs explaining the characteristics of the small halide lamps of the present invention and those of controls.

FIG. 3 shows changes in chromaticity when the mixing ratio of sodium iodide to scandium iodide was varied and when the reference mixture amount of sodium iodide and scandium iodide was 20 mg/cc based on the unit volume of the arc tube. The mixing ratio is indicated in units of by weight. Marks shown in FIG. 3 correspond to those in the table below, respectively.

| Mark | Sodium iodide/Scandium iodide |
|---|---|
| o | 1 |
| + | 2 |
| Δ | 3 |
| □ | 5 |
| x | 7 |
| | 10 |

As shown in FIG. 3, the color temperature greatly differs from the color temperature (3,000 K) of the incandescent lamp but falls in a range near the BBL when the mixing ratio is small. However, when the mixing ratio is increased, the color temperature reaches near 3,000 K, but the chromaticity greatly deviates from the BBL. This is caused by the fact that when the amount of sodium iodide which serves to spread the discharge effect is decreased, that is, when the mixing ratio of sodium iodide with respect to the total content is decreased, the arc is contracted. As a result, light emission from sodium contributing to high luminous efficacy is degraded, and the color temperature is increased. In order to minimize the degradation in luminous efficacy and to decrease the color temperature, the mixing ratio must be more than 3:1. However, when the mixing ratio exceeds 10:1, the color temperature is decreased to less than 2,800 to 2,900 K and is lower than the color temperature of the incandescent lamp. Furthermore, the amount of scandium iodide which contributes to emit continuous light is decreased in comparison with the amounts of other elements, so that the color rendering properties are degraded.

The content of sodium iodide is preferably 3 to 10 times that of scandium iodide in their mixture so as to utilize advantages such as high luminous efficacy, high color rendering properties and a low color temperature of the halides of this type.

The above results as obtained by the small metal halide lamp of 40 W can be obtained by a small metal halide lamp of 100 W or less. Even if a chloride or iodide is used as a halide, it is found that the mixing ratio of 3:1 to 10:1 is suitable. It is also found that the total content of sodium iodide and scandium iodide is 10 to 40 mg/cc per unit volume of the arc tube. If the content is less than 10 mg/cc, light emission by mercury is increased, so that all the advantages of the metal halide lamp are impaired. However, when the content exceeds 40 mg/cc, there is an excess of halides, so that the an unstable arc is produced and color irregularity between the lamps occurs. Therefore, the total content of sodium iodide and scandium iodide must fall in a range of 10 to 40 mg/cc.

Figure 1:
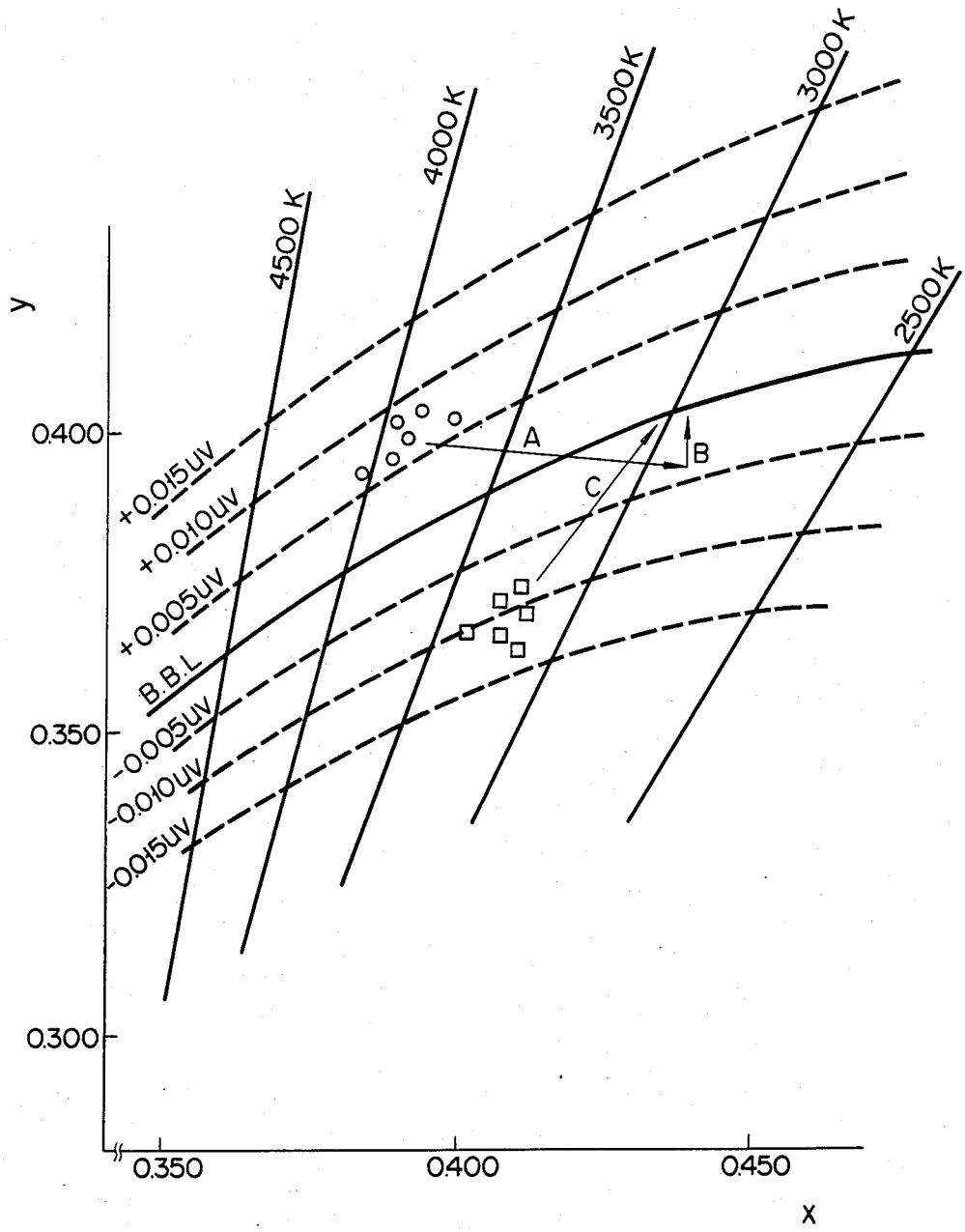
FIG. 1 is a chromaticity diagram of a conventional metal halide lamp.

In a metal halide lamp in which the mixing ratio of sodium iodide to scandium iodide is 3:1 to 10:1, and the total content thereof is 10 to 40 mg/cc, a high luminous efficacy and high color rendering properties are obtained, and a color temperature is near 3,000 K. However, in the lamp of the type described above, as may be apparent from FIGS. 1 and 3, the chromaticity deviates downward from the BBL by about −0.010 UV, thus resulting in disharmony between the colors of light from an incandescent lamp and the metal halide lamp. The present inventors selected samples of lamps of the present invention at random and compared lighting conditions between the lamps of the present invention and incandescent lamps. It was found that the chromaticity deviation from the BBL must be below 0.008 UV in order to obtain equivalent color tone of the metal halide lamp and the incandescent lamp even if their color temperatures are close to each other. When the deviation exceeds −0.010 UV, disharmony between the colors of light from these lamps occurs and often results in discomfort.

In order to solve the above drawbacks, that is, in order to minimize the deviation of chromaticity from the BBL, the phosphor 12 is coated on the inner surface of the envelope 8 so as to correct the chromaticity according to the present invention. The present inventors have made extensive studies on the selection of a proper phosphor. As a result, it was found that the phosphor 12 must be at least one phosphor (first phosphor) selected from the group consisting of a manganese-activated magnesium fluorogermanate phosphor and a cerium-activated yttrium aluminate phosphor so as to effectively correct the chromaticity.

It was also found that the second phosphor consisting of a terbium-activated green-emitting phosphor can be added to the first phosphor to effectively achieve the object of the present invention.

Figure 4:
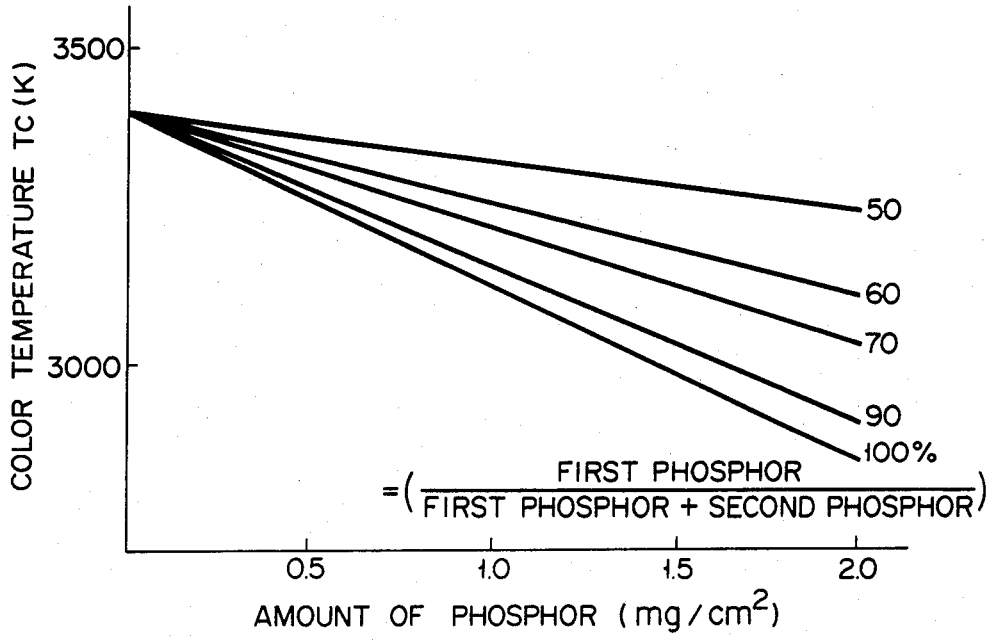
Figure 5:
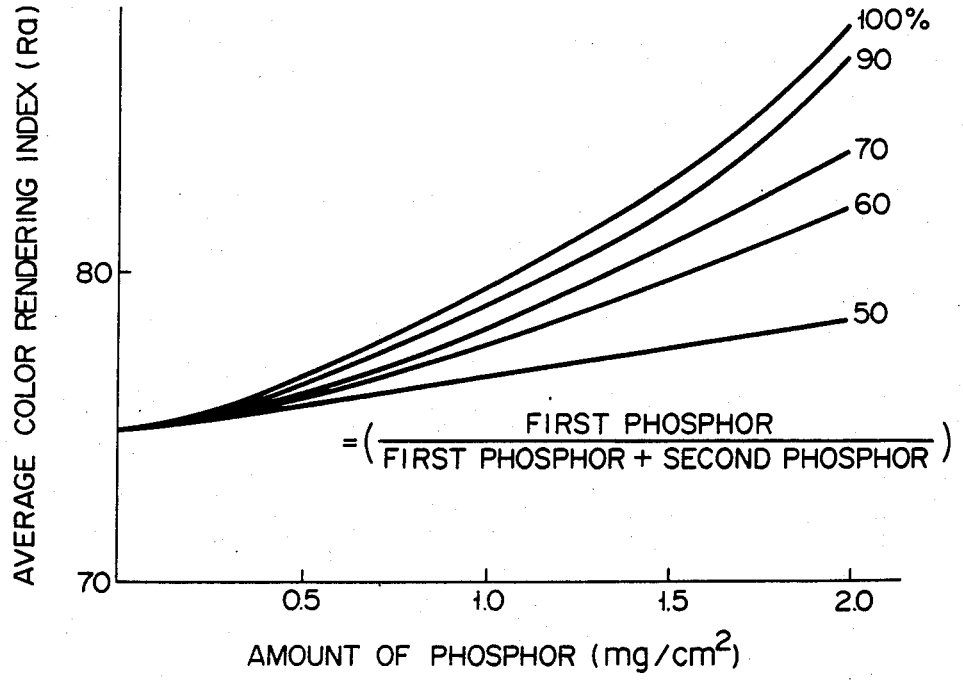
Figure 6:
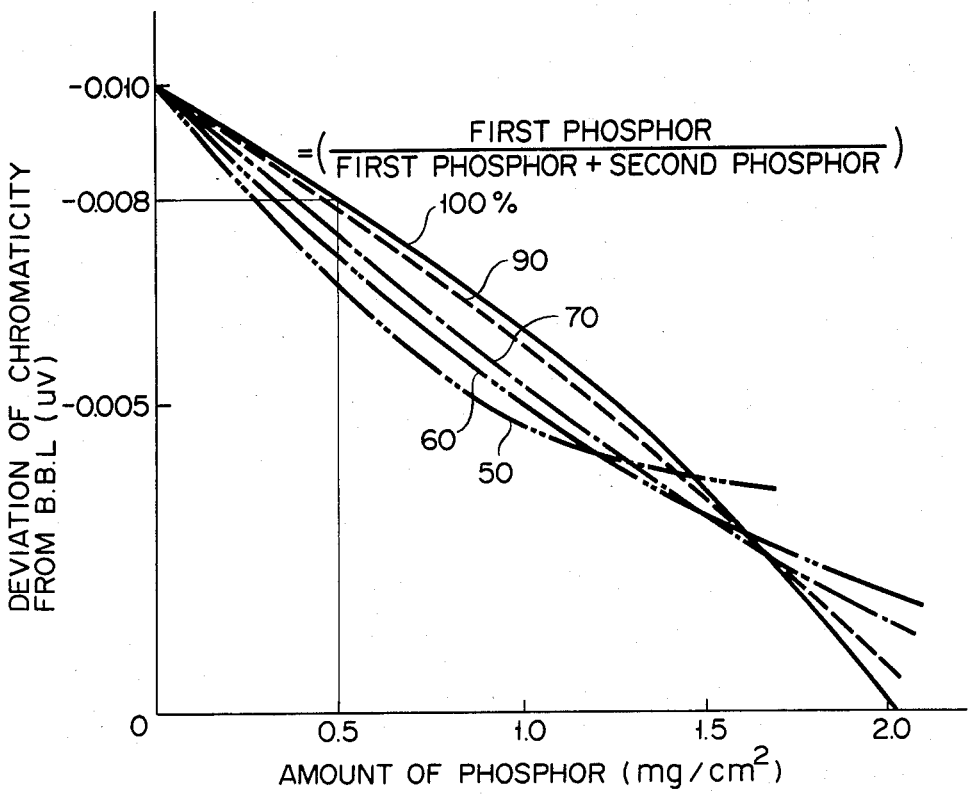

FIGS. 4, 5 and 6 are graphs for explaining the color temperature Tc (K), the average color rendering index Ra, and the deviation of the chromaticity from the BBL as a function of the amount of phosphor applied for unit area in a metal halide lamp of 40 W. The manganese-activated magnesium fluorogermanate is used as the first phosphor, and cerium-, terbium-activated yttrium silicate is used as the second phosphor.

As may be apparent from FIG. 4, when the amount of applied phosphor is increased, the color temperature is decreased. Referring to FIG. 5, when the amount of applied phosphor is increased, the average color rendering index is improved, so that the chromaticity changes in a desired position. Such a tendency is reinforced when only the first phosphor is used. When the second phosphor is mixed in the first phosphor, better results are obtained if the content of the first phosphor is greater than that of the second phosphor. In this case, when the content of the second phosphor exceeds 40% of the total content, that is, when the content of the first phosphor is less than 60% the results are usually poor.

FIG. 6 shows a case in which the chromaticity becomes closer to the BBL to be within an allowable deviation as the amount of phosphor applied is increased. In this case, it is more effective to use a mixture of the first and second phosphor than only the first phosphor so as to minimize the deviation. This is because the green-emitting phosphor serves to decrease the deviation.

Figure 7:
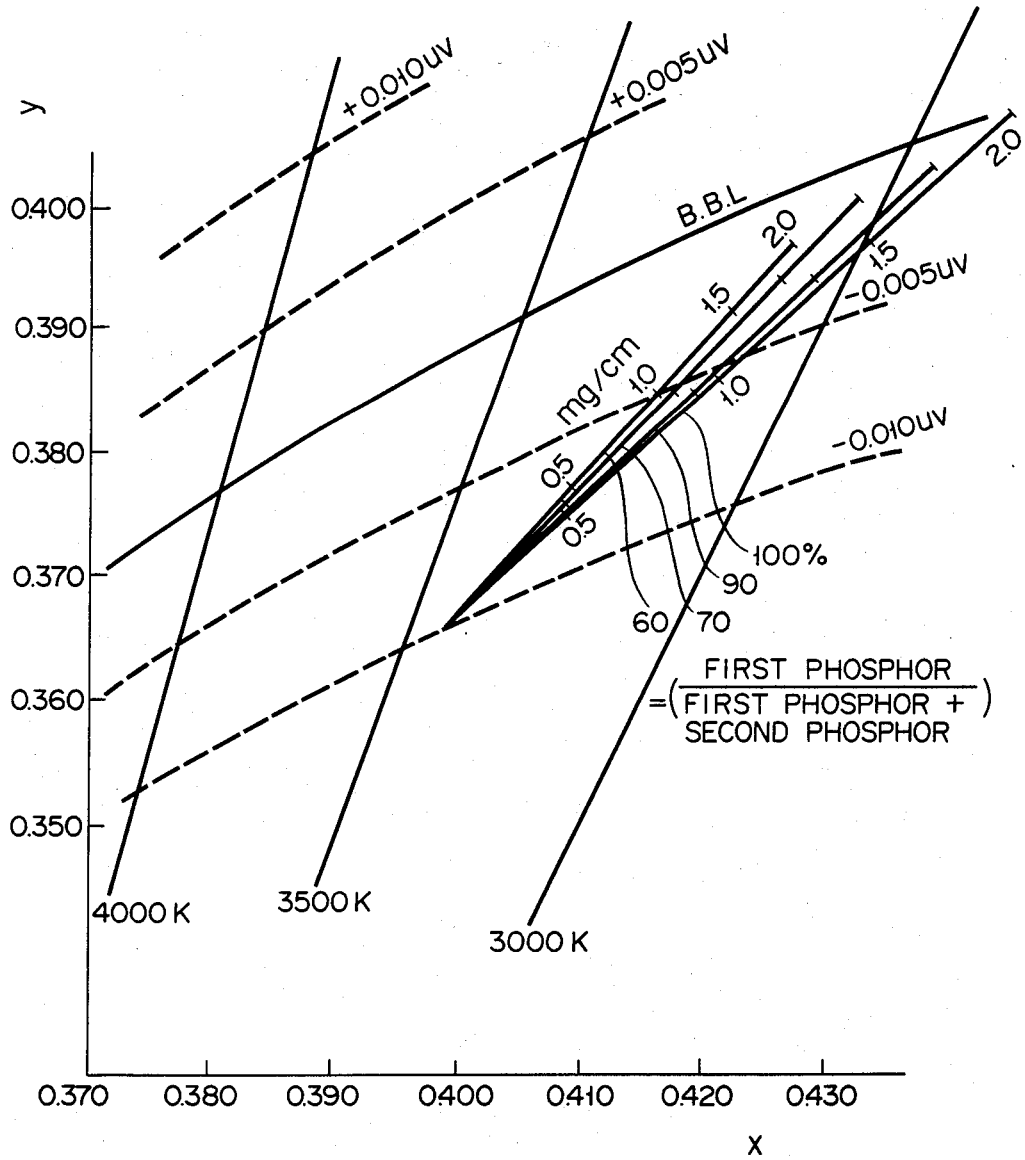

In order to eliminate disharmony between the colors of light from the metal halide lamp and the incandescent lamp, that is, in order to keep any deviation in an allowable deviation range up to −0.008 UV, it is seen from FIG. 6 that the phosphor must be applied in an amount of 0.5 mg/cm$^2$ or more. The results shown in FIGS. 4 and 6 are better understood than those in FIG. 7 in which the results are plotted in the chromaticity diagram. Referring to FIG. 7, in the metal halide lamps in which color temperatures are set at 3,400 K and deviations of the chromaticity from the BBL are set to be −0.010 UV, the amount of applied phosphor and the mixing ratio of the first and second phosphors are variously changed to examine the correction efficiency of the phosphor applied on the inner surface of the envelope. As may be apparent from FIG. 6, when the amount of applied phosphor is increased, the deviation is decreased, that is, the chromaticity reaches near the BBL. When the content of the second phosphor is increased, the chromaticity points are abruptly redistributed to the upper positions on the coordinates. However, when the total amount of applied phosphor is constant, the chromaticity points tend to be more abruptly redistributed to the upper positions on the coordinates with an increase in the amount of the first phosphor. For this reason, as may be apparent from FIG. 7, it is advantageous to increase the amount of the second phosphor to eliminate the deviation in a range of −0.008 to −0.003 UV. When the deviation falls in a range of −0.003 to 0 UV, only the first phosphor can be effectively used.

Figure 8:
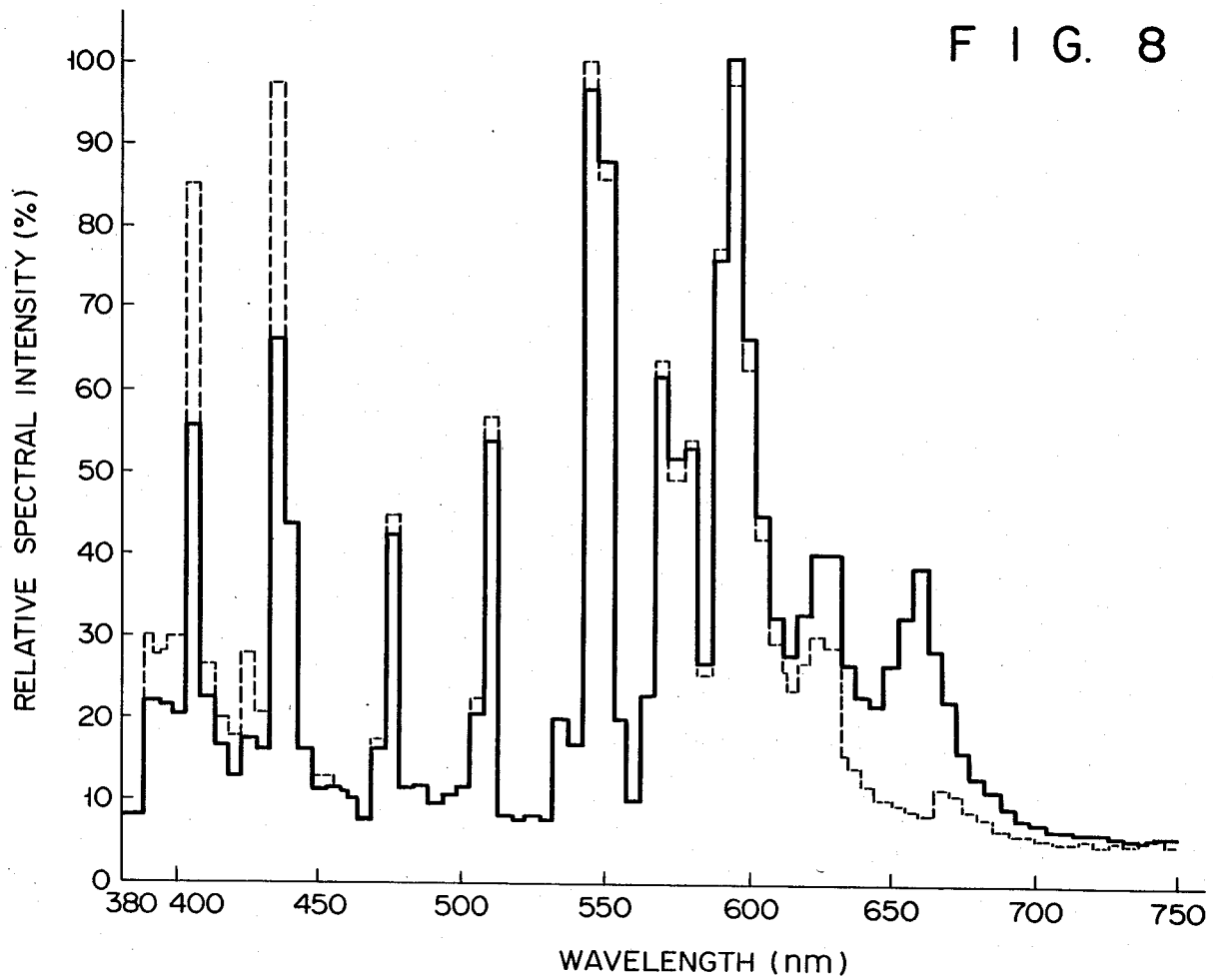

Referring to FIG. 8, the spectral distribution is indicated by the solid line when the first phosphor is contained in an amount of 90% based on the total content and a total amount of applied phosphor is 1.2 mg/cm$^2$, while the spectral distribution is indicated by the broken line when a clear envelope is used in which the phosphor is not applied. As is apparent from FIG. 8, the luminous intensity of the blue light having a wavelength range of 400 to 450 nm is decreased in the envelope with the phosphor film as compared with the clear envelope. However, the luminous intensity of the red light having a wavelength range of 620 to 680 nm is increased. Therefore, in the envelope with the phosphor film, the color temperature is decreased, thus improving the color rendering properties.

When the cerium-activated yttrium aluminate phosphor is used as the first phosphor, the same effect obtained described above can be obtained. When another phosphor selected from the terbium-activated green-emitting phosphors is used as the second phosphor, the same effect is also obtained.

The first phosphor serves to shift the chromaticity points with a slope slightly greater than that of the BBL in the chromaticity diagram shown in FIG. 3 in the metal halide lamp in which a mixing ratio of sodium halide to scandium halide is 3:1 to 10:1 based on weight. In other words, light of wavelengths corresponding to orange and red light rays are intensified. Although the manganese-activated magnesium fluorogermanate phosphor has a wavelength of 660 nm which corresponds to deep red light, the wavelength is changed to orange and red by self-absorption in the chromaticity diagram. Furthermore, the blue light rays are absorbed by the first phosphor, so that when the predetermined amount of phosphor is applied, the first phosphor more effectively changes the wavelength than the second phosphor to improve color rendering properties and to lower the color temperature. The first phosphor must inevitably be used. However, the terbium-activated green-emitting phosphor emits light having a wavelength of about 543 nm, so that the chromaticity points are shifted with an abrupt slope crossing the curve of the BBL. It is very effective to shift the chromaticity points near the BBL. However, the wavelength may often be saturated. Therefore, it is preferred that less than 40% of the second phosphor be added to the first phosphor.

Figure 9:
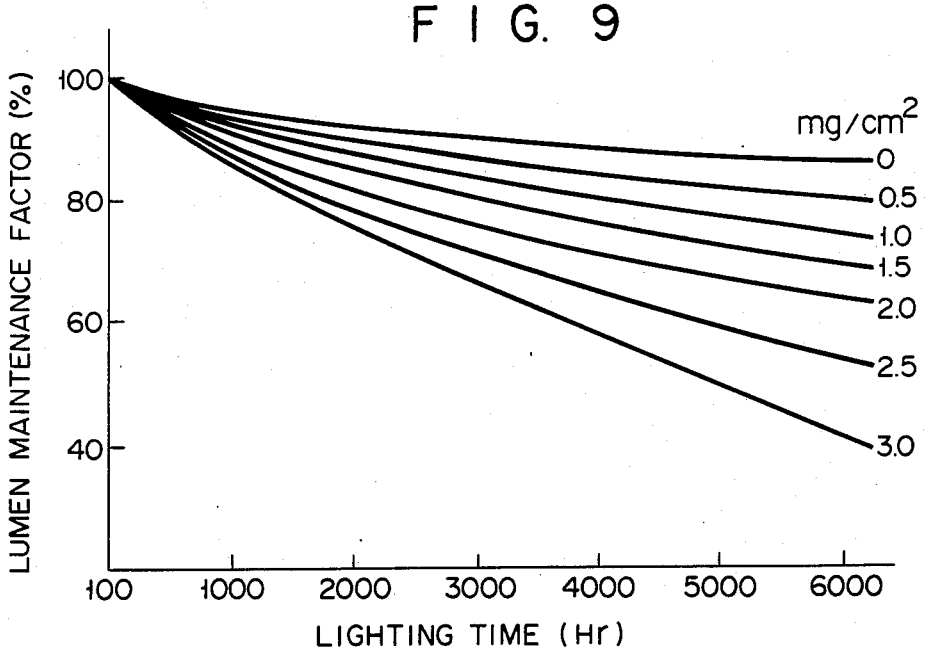

As described above, when the first phosphor is coated on the inner surface of the envelope 8 or when the second phosphor is added to the first phosphor as needed and the resultant phosphor is applied to the inner surface thereof, a light similar to the light of incandescent lamp is emitted from the lamp through the phosphor film even if the original color tone of light is greatly different from the light of incandescent lamp. This effect is prominent when the amount of phosphor is increased. However, when too much phosphor is applied, the luminous flux is decreased, and this shortens the service life. FIG. 9 shows the relationship between the amount of applied phosphor and the lumen maintenance factor. When the amount exceeds 2.0 mg/cm$^2$, the luminous flux is degraded. However, when the amount is less than 2.0 mg/cm$^2$, the luminous flux is decreased by 5 to 6% as compared with the clear type metal halide lamp. In this case, the luminous flux is not so decreased, and at the same time the light of incandescent lamp can also be obtained, thus maximizing the effect of the application of the phosphor.

When the phosphor is applied, the light diffusion is improved, and the luminous intensity distribution is made uniform. Further, since ultraviolet rays are converted to visible light rays, the adverse effects of radiation of ultraviolet rays onto an object to be irradiated can be eliminated. In particular, the ultraviolet ray absorption factor of the first phosphor is high, so that $\frac{1}{3}$ to $\frac{2}{3}$ of the ultraviolet rays can be eliminated as compared with the clear metal halide lamp. When the small metal halide lamp of this type is used in a store or the home, and discoloration of display items or burning of the skin by ultraviolet rays can be effectively prevented.

In summary, since the small metal halide lamp of the present invention has a function to shift the chromaticity points toward the BBL by means of the envelope with the phosphor film, the chromaticity of the metal halide lamp is improved in addition to the advantages of the high luminous efficacy, the high color rendering properties, and the low color temperature. The color tone of light emitted from the lamp through the phosphor film resembles that of an incandescent lamp. Therefore, the disharmony between the small metal halide lamp of this type and the incandescent lamp is eliminated, so that the metal halide lamp can be used in place of the indoor incandescent lamp.

Furthermore, when the second phosphor is used which serves to shift the chromaticity points closer to the BBL in addition to the first phosphor, the chromaticity can be further improved.

What is claimed is:

1. A small metal halide lamp adapted for a power input of not more than 100 watts, comprising:

an arc tube having a pair of electrodes spaced apart from each other and containing a rare gas, mercury, sodium halide and scandium halide therein, with a mixing ratio of sodium halide to scandium halide based on weight within the range of 3:1 to 10:1, and a total content of said sodium halide and said scandium halide within the range of 10 to 40 mg per unit volume (cc) of said arc tube; and an envelope for housing said arc tube with at least one phosphor applied on an inner surface of said envelope so that the chromaticity of light produced by said lamp does not greatly deviate from the black body locus standard, and wherein said phosphor is at least one of the phosphors selected from the group consisting of a manganese-activated magnesium fluorogermanate phosphor and a cerium-activated yttrium aluminate phosphor.

2. A lamp according to claim 1, wherein said envelope further has a green-emitting phosphor applied on the inner surface thereof.

3. A lamp according to claim 1, wherein said at least one phosphor is applied on the inner surface of said envelope in an amount of 0.5 to 2.0 mg/cm$^2$.

4. A lamp according to claim 2, wherein the total content of the phosphors applied on the inner surface of said envelope is an amount of 0.5 to 2.0 mg/cm$^2$.

5. A lamp according to claim 2, wherein said green-emitting phosphor comprises a terbium-activated green-emitting phosphor.

6. A lamp according to claim 5, wherein said green-emitting phosphor is at least one phosphor selected from the group consisting of: cerium-, terbium-activated yttrium silicate; cerium-, terbirum-activated magnesium aluminate; terbium-activated yttrium phosphate; terbium-activated lanthanum phosphate; cerium-, terbium-activated lanthanum phosphate; and a material obtained by substituting part of the lanthanum of cerium-, terbium-activated lanthanum phosphate by another element.

7. A lamp according to claim 2, wherein said green-emitting phosphor is not more than 40% of a total phosphor content.

8. A lamp according to claim 1, wherein said arc tube has a shape of one of an ellipsoid and a spheroid.

* * * * *